US006409563B1

(12) United States Patent
Tamura et al.

(10) Patent No.: US 6,409,563 B1
(45) Date of Patent: Jun. 25, 2002

(54) ELECTRON-EMITTING DEVICE MANUFACTURING METHOD AND APPARATUS, DRIVING METHOD, AND ADJUSTING METHOD

(75) Inventors: Miki Tamura, Isehara; Keisuke Yamamoto, Yamato; Yasuhiro Hamamoto, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,386

(22) Filed: Feb. 23, 2000

(30) Foreign Application Priority Data

Feb. 23, 1999 (JP) ..... 11-045532
Feb. 21, 2000 (JP) ..... 2000-042952

(51) Int. Cl.[7] ..... H01J 9/02
(52) U.S. Cl. ..... 445/3; 445/6; 445/24
(58) Field of Search ..... 445/3, 6, 24

(56) References Cited

U.S. PATENT DOCUMENTS 5,591,061 A * 1/1997 Ikeda et al. ..... 445/3
6,147,449 A * 11/2000 Iwasaki et al. ..... 313/495

OTHER PUBLICATIONS

J. Dyke et al., "Field Emission", Advances in Electronics and Electron Physics, vol. VIII, 1956, pp. 89–185.
M.I. Elinson et al., "The Emission of Hot Electrons and The Field Emission of Electrons From Tin Oxide", Radio Engineering and Electronic Physics, Jul. 1965, pp. 1290–1296.
H. Araki, "Electroforming and Electron Emission of Carbon Thin Films", Journal of the Vacuum, Society of Japan, 1983, pp. 22–29 (with English Abstract on p. 22).
G. Dittmer, "Electrical Conduction and Electron Emission of Discontinuous Thin Films", Thin Solid Films, 9, 1972, pp. 317–328.
M. Hartwell, "Strong Electron Emission From Patterned Tin–Indium Oxide Thin Films", IEDM, 1975, pp. 519–521.
C.A. Spindt, "Physical Properties of Thin–Film Emission Cathodes with Molybdenum Cones", J. Applied Physics, vol. 47, No. 12, Dec. 1976, pp. 5248–5263.
C.A. Mead,"Operation of Tunnel–Emission Devices", Journal of Applied Physics, Apr. 1961, pp. 646–652.

* cited by examiner

*Primary Examiner*—Kenneth J. Ramsey
(74) *Attorney, Agent, or Firm*—Fitzpatrick, Cella, Harper & Scinto

(57) ABSTRACT

In manufacturing or adjusting an electron-emitting device which has at least two electrodes and emits electrons by applying a voltage between the two electrodes, or before performing normal driving, a voltage V1 is applied which has the following relationship with a maximum voltage value V2 applied as a normal driving voltage to the electron-emitting device between the two electrodes. Giving a current I flowing upon application of a voltage V when the voltage V falling within a voltage range causing electron emission upon application of the voltage between the two electrodes is applied between the two electrodes:

$$I=f(V)$$

and letting f'(V) be the differential coefficient of f(V) at the voltage V, the voltage V1 has a relationship with the voltage V2 that satisfies, upon application of the voltage, the first condition:

$$f(V1)/\{V1\cdot f'(V1)-2f(V1)\}>f(V2)/\{V2\cdot f'(V2)-2f(V2)\}$$

Further, letting Xn-1 be the value of the right side of inequality (2) upon a first application of the pulse-like voltage V2 when the voltage V2 is applied as pulses successively twice between the two electrodes after application of the voltage V1, and Xn be the value of the right side of inequality (2) upon a second application of the pulse-like voltage V2, the relationship with the voltage V2 satisfies the second condition that Xn–1 and Xn satisfy:

$$(Xn\text{-}1-Xn)/Xn\text{-}1\leqq 0.02$$

14 Claims, 12 Drawing Sheets

ELECTRON-EMITTING DEVICE MANUFACTURING METHOD AND APPARATUS, DRIVING METHOD, AND ADJUSTING METHOD

FIELD OF THE INVENTION

The present invention relates to an electron-emitting device manufacturing method and apparatus, driving method, and adjusting method thereof.

BACKGROUND OF THE INVENTION

Conventionally, electron-emitting devices are mainly classified into two types of devices: thermionic and cold cathode electron-emitting devices. Known examples of the cold cathode electron-emitting devices are field emission type electron-emitting devices (to be referred to as FE type electron-emitting devices hereinafter), metal/insulator/metal type electron-emitting devices (to be referred to as MIM type electron-emitting devices hereinafter), and surface-conduction type of electron-emitting devices (to be referred to as SCE type electron-emitting devices hereinafter.

Known examples of the FE type electron-emitting devices are disclosed in W. P. Dyke and W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976).

A known example of the MIM type electron-emitting devices is disclosed in C. A. Mead, "Operation of Tunnel-Emission Devices", J. Appl. Phys., 32,646 (1961).

A known example of the SCE type electron-emitting devices is disclosed in, e.g., M. I. Elinson, Radio Eng. Electron Phys., 10, 1290 (1965).

The SCE type device utilizes the phenomenon that electrons are emitted from a small-area thin film formed on a substrate by flowing a current parallel through the film surface. The SCE type electron-emitting device includes electron-emitting devices using an $SnO_2$ thin film according to Elinson mentioned above [M. I. Elinson, Radio Eng. Electron Phys., 10, 1290, (1965)], an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like.

The FE, MIM, and SCE type electron-emitting devices have an advantage that many devices can be arranged on a substrate. Various image display apparatuses using these devices have been proposed.

It is known that characteristic changes in actual driving can be suppressed by applying a voltage higher than a voltage applied in the actual driving in the manufacturing process of the SCE type electron-emitting device.

An image display apparatus formed using the electron-emitting devices must maintain brightness and contrast suitable for image display over a long term.

To realize this, the electron-emitting device must emit a predetermined electron amount or more in an expected term, while suppressing a decrease in electron amount emitted by the electron-emitting device.

However, the conventional electron-emitting device gradually decreases the electron emission amount along with long-term driving at a constant driving voltage.

In any type of electron-emitting device described above, the field strength near the electron-emitting portion is high during the actual driving. Changes over time near the electron-emitting portion arising from a high field strength is considered to decrease the electron emission amount.

SUMMARY OF THE INVENTION

It is an object of the present invention to provide an electron-emitting device manufacturing method and driving method capable of suppressing changes over time in characteristics of an electron-emitting device and, more particularly, to provide an electron-emitting device manufacturing method and driving method capable of suppressing a decrease over time and unstableness in the electron emission amount from the electron-emitting device.

An electron-emitting device manufacturing method according to the present invention has the following steps.

That is, there is provided a method of manufacturing an electron-emitting device which has at least two electrodes and emits electrons by applying a voltage between the two electrodes, comprising:

the voltage application step of applying a voltage V1 between the two electrodes, the voltage V1 being a voltage having a relationship with a maximum voltage value V2 applied to the electron-emitting device as a normal driving voltage after the voltage application step, so as to satisfy giving a current I flowing upon application of a voltage V when the voltage V falling within a voltage range causing electron emission upon application of the voltage between the two electrodes is applied between the two electrodes:

$$I=f(V) \tag{1}$$

and letting f'(V) be a differential coefficient of f(V) at the voltage V, a first condition:

$$f(V1)/\{V1\cdot f'(V1)-2f(V1)\}>f(V2)/\{V2\cdot f'(V2)-2f(V2)\} \tag{2}$$

wherein the voltage application step satisfies a second condition, upon completion of the voltage application step, wherein the second condition is defined by letting Xn-1 be a value of a right side, i.e., f(V2)/{V2·f'(V2)−2f(V2)} of the inequality (2) upon a first application of the pulse-like voltage V2 when the voltage V2 is applied as pulses successively twice between the two electrodes upon completion of the voltage application step, and Xn be a value of the right side, i.e., f(V2)/{V2·f'(V2)−2f(V2)} of the inequality (2) upon a second application of the pulse-like voltage V2, wherein Xn-1 and Xn satisfy:

$$(Xn\text{-}1-Xn)/Xn\text{-}1\leqq 0.02 \tag{A}$$

The second condition is that Xn-1 and Xn satisfy:

$$(Xn\text{-}1-Xn)/Xn\text{-}1\leqq 0.01 \tag{B}$$

The electron-emitting device manufactured through the voltage application step hardly changes its characteristics upon long-time application of the maximum voltage value V2 applied in actually driving the electron-emitting device (normally using it). The current I flowing upon application of the voltage V when the voltage V falling within a voltage range causing electron emission upon application of the voltage between the two electrodes is applied between the two electrodes is a current emitted upon application of the voltage V or a current flowing between the two electrodes. For example, in an FE or SCE type electron-emitting device, the current I is an emitted current or a current flowing between a pair of electrodes.

In an MIM type electron-emitting device, the current I is an emitted current or a current (diode current) flowing between two electrodes sandwiching an insulating layer. The differential coefficient f'(Vn) of f(Vn) at a given voltage Vn can be obtained as follows. An emission current (or a current flowing between two electrodes) In upon application of the voltage Vn, and an emission current (or a current flowing between the two electrodes) In2 upon application of a voltage Vn2 lower by a small amount dVn than the voltage Vn immediately after or immediately before application of the voltage Vn are obtained, and (In−In2) is divided by dVn. That is, f(V)/{V·f'(V)−2f(V)} can be calculated as In/{Vn·(In−In2)/dVn−2In}.

Especially, the second condition is more preferably a condition that the change rate of Xn, i.e., (Xn-1−Xn)/Xn-1 is 1% or less.

The voltage V1 can be applied by various methods. The magnitude of the voltage V1 is not necessarily constant as long as the voltage V1 satisfies the condition of the inequality (2). The voltage V1 is preferably applied as a pulse-like voltage.

To satisfy the second condition by the voltage application step, a voltage is applied under the same conditions as those adopted in applying the present invention, between two electrodes identical to two electrodes constituting at least part of an electron-emitting device to which the present invention is applied. Xn-1 and Xn are measured for the electron-emitting device obtained in this step, thereby attaining conditions under which Xn-1 and Xn satisfy the inequality (A), and more preferably the inequality (B). For example, when the voltage V1 which satisfies the inequality (2) is applied as pulses a plurality of number of times in the voltage application step, the number of application times of the pulse voltage V1 that can satisfy the second condition is obtained in advance, and the pulse-like voltage is applied the determined number of times in the voltage application step. Alternatively, the duration of the voltage application step that can satisfy the second condition may be obtained in advance, and the voltage application step may be performed for the determined duration. The voltage application step may also be performed while monitoring characteristics to directly or indirectly confirm whether the second condition is satisfied. For example, the second condition is confirmed to be satisfied when the left side of the inequality (2) i.e., the change rate of f(V1)/{V1·f'(V1)−2f(V1)} reaches a predetermined value (e.g., 5% or 3%) or less in the voltage application step. In the voltage application step, the change rate of f(V1)/{V1·f'(V1)−2f(V1)} is obtained every time, e.g., the pulse-like voltage V1 is applied. If the change rate reaches the previously confirmed value or less, the voltage application step ends. Alternatively, the voltage V2 may be actually applied between two electrodes during the voltage application step to confirm whether the second condition is satisfied. Until the second condition is confirmed to be satisfied, the voltage application step and the confirmation step by the application of the voltage V2 may be repeated to realize the voltage application step which satisfies the second condition.

In the manufacturing method of the present invention, the voltage application step is preferably performed in a high-vacuum atmosphere.

In the manufacturing method of the present invention, when the two electrodes sandwich a gap, the voltage application step is preferably performed in an atmosphere in which the gap between the two electrodes is not made narrow by deposition of a substance in the atmosphere or a substance originating from the substance in the atmosphere in the voltage application step.

In the manufacturing method of the present invention, the voltage application step is preferably performed in an atmosphere in which carbon and a carbon compound in the atmosphere have a partial pressure of $1\times10^{-6}$ Pa or less. The partial pressure is more preferably $1\times10^{-8}$ Pa or less. The total pressure is preferably $1\times10^{-5}$ Pa or less, and more preferably $1\times10^{-6}$ Pa or less.

Assume that the second condition is satisfied if Xn-1 and Xn satisfy (Xn-1−Xn)/Xn-1≦0.02 or (Xn-1−Xn) /Xn-1≦0.01 in the atmosphere upon the voltage application step.

As described above, two electrodes to which the voltage is applied in the voltage application step are a pair of electrodes of an FE type electron-emitting device (e.g., an emitter cone electrode and gate electrode for a Spindt type electron-emitting device), a pair of electrodes of an SCE type electron-emitting device (e.g., high- and low-potential electrodes), or a pair of electrodes sandwiching an insulating layer in an MIM type electron-emitting device.

The present invention can be preferably applied to an electron-emitting device such as an FE or SCE type electron-emitting device in which a gap is formed between two electrodes to which an electron emission voltage is applied.

The present invention incorporates an electron-emitting device manufacturing apparatus used in the electron-emitting device manufacturing method. This apparatus comprises a potential output portion for applying a voltage between the two electrodes.

An electron-emitting device driving method according to the present invention has the following steps.

That is, there is provided a method of driving an electron-emitting device which has at least two electrodes and emits electrons by applying a voltage between the two electrodes, wherein the electron-emitting device undergoes the voltage application step of applying a voltage V1 between the two electrodes, the driving method comprises a driving process of driving the electron-emitting device using a maximum value of a normal driving voltage as V2, the voltage V1 is a voltage having a relationship with the voltage V2 so as to satisfy giving a current I flowing upon application of a voltage V when the voltage V falling within a voltage range causing electron emission upon application of the voltage between the two electrodes is applied between the two electrodes:

$$I=f(V) \tag{1}$$

and letting f'(V) be a differential coefficient of f(V) at the voltage V, a first condition:

$$f(\mathbf{V1})/\{\mathbf{V1}\cdot f'(\mathbf{V1})-2f(\mathbf{V1})\}>f(\mathbf{V2})/\{\mathbf{V2}\cdot f'(\mathbf{V2})-2f(\mathbf{V2})\} \tag{2}$$

the voltage application step includes the step of, upon completion of the voltage application step, letting Xn-1 be a value of f(V2)/{V2·f'(V2)−2f(V2)} upon application of the pulse-like voltage V2 when the voltage V2 is applied as pulses successively twice between the two electrodes upon completion of the voltage application step, and Xn be a value of f(V2)/{V2·f'(V2)−2f(V2)} upon next application of the pulse-like voltage V2, satisfying a second condition that Xn-1 and Xn satisfy:

$$(Xn\text{-}1-Xn)/Xn\text{-}1 \leqq 0.02 \quad \text{(A)}$$

The present invention incorporates an adjusting method used for adjustment before shipping in the voltage application step described as the voltage application step in the manufacturing method, or for adjustment after the start of actual use.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in embodiments of the invention and constitute a part of the invention, serve to explain the principles of the invention together with the present specification.

DETAILED DESCRIPTION OF THE PREFERRED EMBODIMENT

A preferred embodiment of the present invention will be described in detail below with reference to the accompanying drawings.

A means for solving the above problems will be explained in detail.

Figure 2:
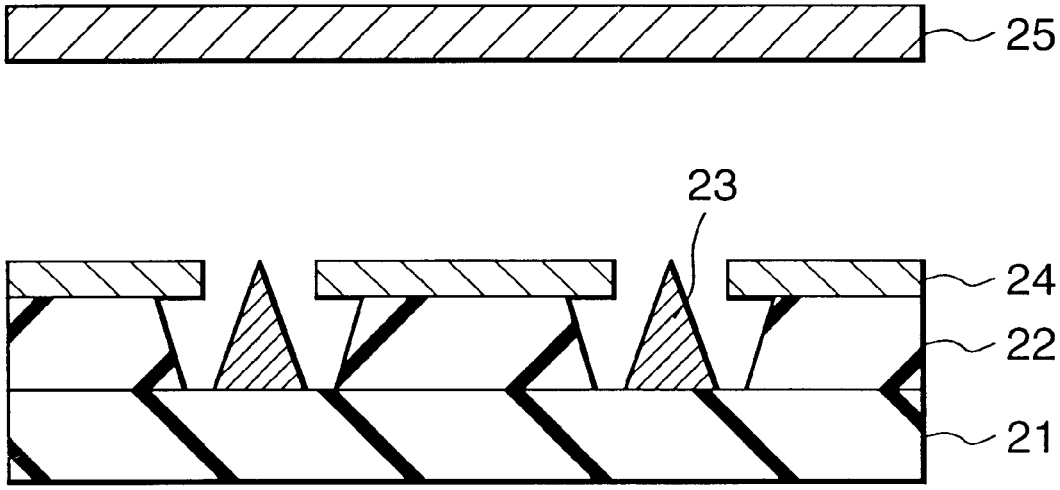
FIG. 2 is a schematic sectional view showing an FE type electron-emitting device to which the present invention can be applied.

FIG. 2 is a schematic view showing an example of an FE type electron-emitting device to which the present invention can be applied.

In FIG. 2, reference numeral 23 denotes a cathode; 24, a gate electrode for emitting electrons from the cathode; 21, an electrode for electrically connecting the cathode 23; 22, an insulating layer for electrically insulating the cathode 23, electrode 21, and gate electrode 24; and 25, an anode for capturing electrons emitted by the cathode 23.

FIGS. 3A to 3E are views showing a typical example of the arrangement and manufacturing method of the FE type electron-emitting device.

In FIGS. 3A to 3E, a substrate 21 is made from a silicon substrate. An insulating layer 22 of silicon oxide is formed on the substrate 21 to a thickness of several hundred nm to several μm by thermal oxidization, sputtering, chemical vapor deposition, or the like. A gate electrode film of molybdenum or the like is formed to a thickness of several hundred nm to several μm by electron beam deposition or the like. A resist pattern corresponding to a prospective cathode formation position is formed on the gate electrode film using general lithography. An opening several hundred nm to several μm in diameter is formed in the gate electrode material by etching, thereby forming a gate electrode 24. The insulating layer 22 at a position corresponding to the opening of the gate electrode 24 is removed with buffer hydrofluoric acid or the like. Then, the resist pattern is removed. While the substrate is rotated in a vacuum evaporator, a metal layer of aluminum or the like is diagonally deposited, and a cathode electrode material of molybdenum or the like is vertically deposited on the substrate to form a cathode 23. The metal layer of aluminum or the like and the cathode electrode material formed on the gate electrode 24 are removed to complete an FE type electron-emitting device.

When an image display apparatus is to be manufactured using the FE type electron-emitting device, the anode 25 having fluorescent substances is arranged at a position apart from the surface having the cathode 23, and a vacuum vessel incorporating these members is formed.

In the electron-emitting device prepared in this manner, a voltage is applied between the cathode 23 and the gate electrode 24 to emit electrons from the distal end of the cathode 23. The emitted electrons are accelerated by the anode 25 to cause them to collide against the fluorescent substances formed on the anode 25, thereby emitting light from the fluorescent substances on the anode 25. At this time, the voltage applied between the cathode 23 and the gate electrode 24 is selected to make the cathode 23 serve as a low-potential side, and is set to a voltage (several ten V to several hundred V) at which electrons are emitted. The anode 25 is constituted by arranging fluorescent substances on, e.g., a transparent electrode formed on a glass substrate so as to externally emit light. An acceleration voltage (100 V to several kV or more) necessary for emitting light from the fluorescent substances is applied to the anode 25.

One pixel is made up of a group of one or more FE type electron-emitting devices formed close to each other, and a fluorescent substance corresponding to the devices. In an image display apparatus having a plurality of pixels formed in a matrix, each pixel to be displayed is selected and driven, thereby displaying an image.

Figure 1:
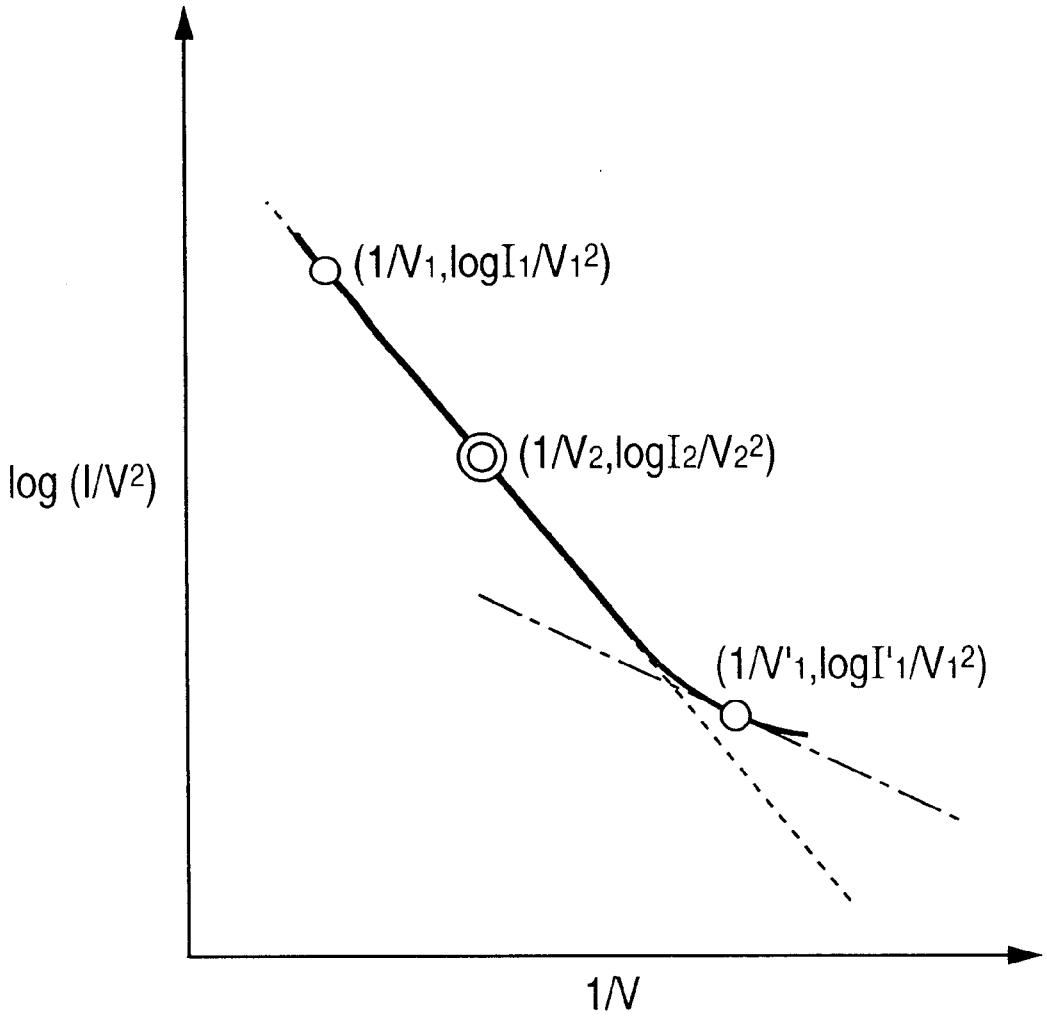
FIG. 1 is a graph showing the plot of the electrical characteristics of an electron-emitting device to which the present invention can be applied.

The FE type electron-emitting device with this structure to which the present invention can be applied has an electrical characteristic shown in FIG. 1.

The abscissa in the graph of FIG. 1 represents the reciprocal of a voltage V applied between the cathode 23 and the gate electrode 24, and the ordinate represents the logarithm of a value obtained by dividing a current I flowing between the cathode 23 and the anode 25 by the square of the voltage V. The electrical characteristic of the FE type electron-emitting device is plotted on this graph to generally draw a continuous line like the one plotted in FIG. 1.

According to Fowler and Nordheim, the current I emitted by the FE type electron-emitting device, and the voltage V applied between the cathode and the gate have a relation:

$$I=A\cdot(\beta\cdot V)^2\cdot\exp(-B/(\beta\cdot V)) \quad (4)$$

where A and B are constants depending on the material and emission area near the electron-emitting portion, and β is a parameter depending on the shape near the electron-emitting portion. The value obtained by multiplying the voltage V by β represents the field strength.

The qualitative value of β can be estimated by plotting $\log(I/V^2)$ with respect to 1/V and calculating a gradient S of a straight line (broken line in FIG. 1). A value obtained by adding a negative sign to a value calculated by dividing the application voltage V by the gradient S of the approximate straight line:

$$-V/S \quad (5)$$

is obviously proportional to the strength of a field generated between the cathode 23 and the gate 24.

This relationship is generalized. If the relationship between the emission current I and the voltage V is given by a function:

$$I=f(V) \quad (6)$$

and f'(V) represents the differential coefficient of f(V), the field strength at the voltage V is proportional to $$f(V)/\{V\cdot f'(V)-2f(V)\} \quad (7)$$

This is defined as a field strength equivalent value.

The representative value of the field strength in the FE type electron-emitting device is as very high as $10^7$ V/cm order. The value of the field strength applied to the insulating layer 22 is about $10^6$ V/cm.

If long-period driving continues by a general method at a high field strength, constituent members irregularly change in the strong field, and the emission current value becomes unstable.

If such change irreversibly occurs, the emission current often decreases. This appears as a decrease in luminance in the image display apparatus.

Current unstableness during driving can be reduced by performing the voltage application step (to be referred to as "pre-driving" hereinafter) of the present invention prior to normal driving.

Pre-driving of the present invention is executed by, e.g., the following procedures.

Figure 4:
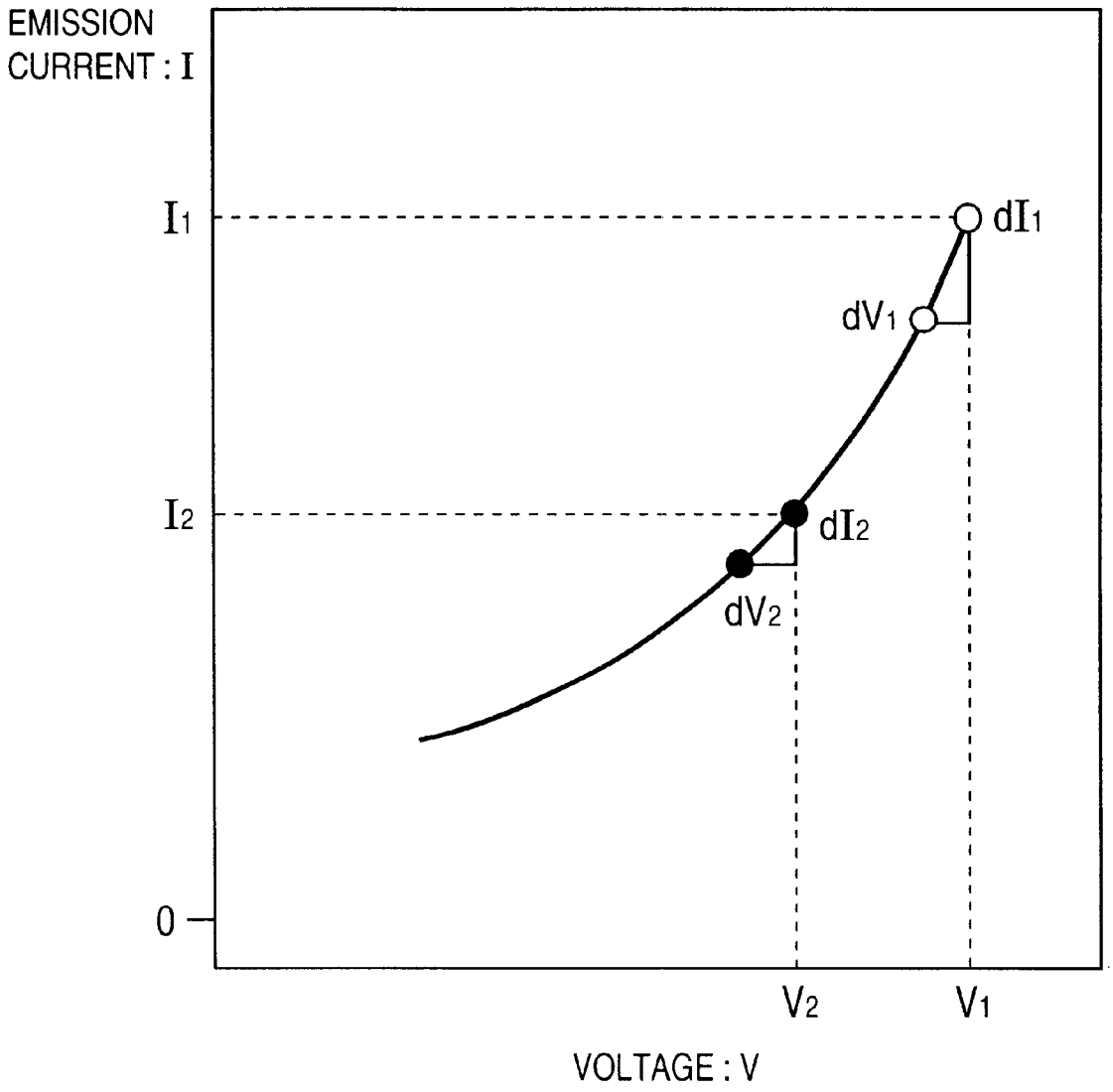
FIG. 4 is a graph showing the electrical characteristics of an electron-emitting device formed in Example 1 and Example 2.

Application voltages and emission currents at at least two different driving voltages for an electron-emitting device to be pre-driven, and the differential coefficients of the emission currents at these application voltages are obtained. For example, as shown in FIG. 4, f'(V1)=dI1/dV1 is calculated from an emission current value I1 corresponding to an application voltage V1, and an emission current change amount dI1 upon slightly changing V1 by dV1. Similarly, an emission current value I2 corresponding to V2, and f'(V2)=dI2/dV2 are calculated.

I1 and I2 are substituted into f(V) in equation (6) corresponding to the application voltages V1 and V2, and values calculated by relation (7) are compared. When, for example, $$I1/(V1\cdot dI1/dV1-2\cdot I1)>I2/(V2\cdot dI2/dV2-2\cdot I2) \quad (8)$$

is established, V1 is adopted as a pre-driving voltage (to be referred to as Vpre hereinafter), and V2 is adopted as a normal driving voltage (to be referred to as Vdrv hereinafter). In this case, the normal driving voltage means a voltage applied in using the electron-emitting device (or apparatus including it), and has a maximum value within a normal voltage application range in normal driving.

To the contrary, when $$I1/(V1\cdot dI1/dV1-2\cdot I1)<I2/(V2\cdot dI2/dV2-2\cdot I2) \quad (9)$$

is established, V2 is adopted as a pre-driving voltage (to be referred to as Vpre hereinafter), and V1 is adopted as a normal driving voltage (to be referred to as Vdrv hereinafter).

By driving the electron-emitting device for a while at the pre-driving voltage Vpre calculated by this method, the electron-emitting portion serving as a main electron-emitting source at the voltage Vpre is driven by a high field strength. Accordingly, changes in constituent members causing unstableness can concentratedly appear within a short period to reduce variation factors.

When an inequality like the inequality (9) holds at voltages which satisfy V1>V2, the normal driving voltage Vdrv is higher than the pre-driving voltage Vpre, and a higher field strength is applied to an electron-emitting portion (to be referred to as an electron-emitting portion A) changed at the voltage Vpre upon application of the voltage Vdrv. However, the main electron-emitting source which determines the electron emission amount at this time shifts to another electron-emitting portion (to be referred to as an electron-emitting portion B), and contribution of the electron-emitting portion A to the entire emission current is small. Even in this relationship, pre-driving is effective. By applying the voltage Vpre in advance, large variation factors at the electron-emitting portion A can be reduced in advance to prevent destructive variations at the driving voltage Vdrv.

Pre-driving desirably continues until the field strength in driving stabilizes. According to the experimental results by the present inventors, if pre-driving continues until the relative change rate of the field strength in pre-driving reaches 5% or less, the change rate of the field strength can be kept within about 5% even upon subsequent driving. The change rate of the field strength in application of an actual driving voltage, and particularly, the change rate of the field strength in the initial stage of application of an actual driving voltage can be reduced to satisfactorily realize the pre-driving effect. From the relation (7), pre-driving is continued until the change rate of the value of f(V1)/{V1·f'(V1)−2f(V1)} reaches 5% or less.

In pre-driving, the voltage is applied while monitoring the change rate of the field strength in pre-driving. The pre-driving voltage can suitably use a pulse voltage. For example, the voltage is applied while the change rate of the field strength is calculated during a pulse idle time (time interval from application of a pulse voltage to application of the next pulse voltage). When the change rate reaches 5% or less, application of the voltage is stopped.

To monitor the change rate of the field strength in pre-driving, the following method can be employed. In pre-driving, the pre-driving voltage V1, and a voltage V12 different from V1 by a small voltage amount dV1 are successively applied. Currents I1 and I12 flowing upon application of these voltages, and a difference dI1 between I1 and I12 are obtained. Since f'(V1)=dI1/dV1, and f(V1)=I1 from the equation (1), the field strength equivalent value f(V1)/{V1·f'(V1)−2f(V1)} is rewritten into $$\text{Epre}=I1/(V1\cdot dI1/dV1-2\cdot I1) \quad (3)$$

The change rate of the field strength can, therefore, be obtained by monitoring the change rate of the value Epre.

Figure 11A:
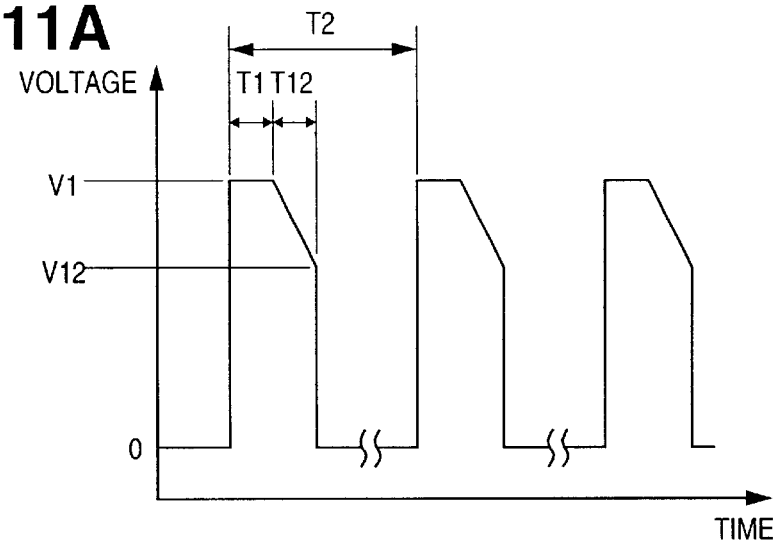
FIGS. 11A to 11C are graphs each showing a voltage waveform used in pre-driving of the present invention.
Figure 11B:
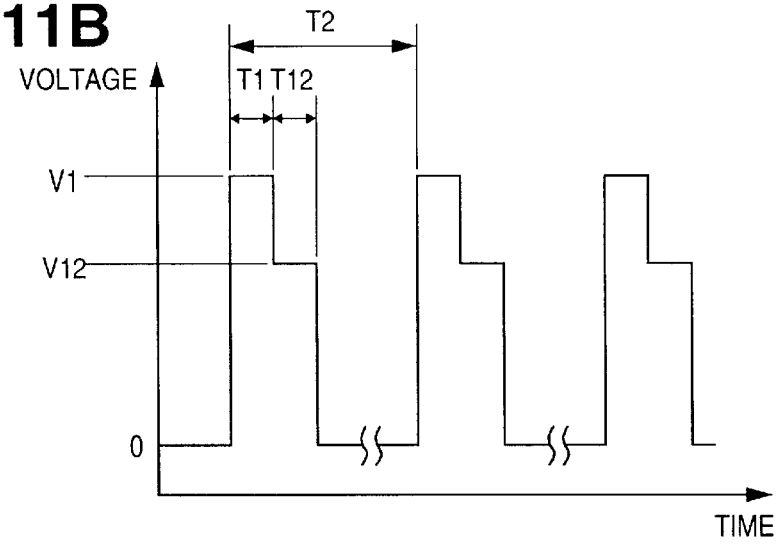
Figure 11C:
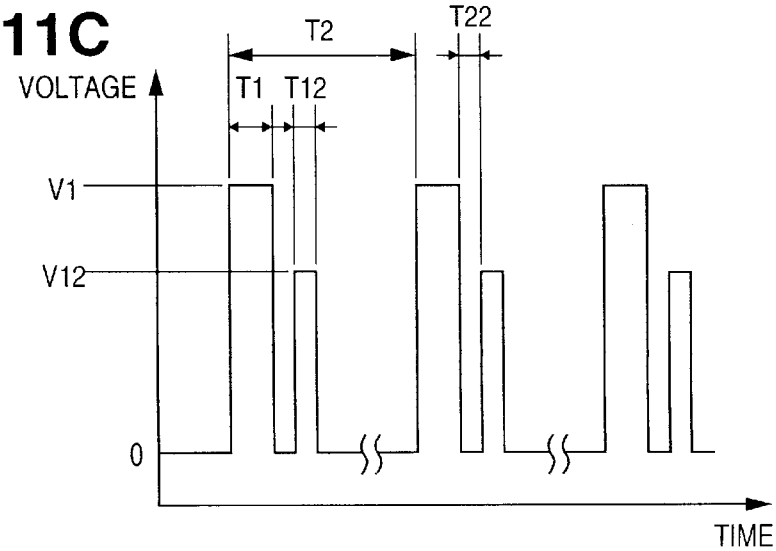

As a voltage waveform in pre-driving, voltage waveforms as shown in FIGS. 11A, 11B, and 11C can be employed. FIG. 11A shows a voltage waveform representing that the voltage changes from a voltage V1 to V12 within a time period T12 after the pre-driving voltage V1 is applied for a time period T1. FIG. 11B shows a voltage waveform representing that the voltage V12 is applied for the time period T12 immediately after the pre-driving voltage V1 is applied for the time period T1. FIG. 11C shows a voltage waveform representing that the voltage is off and then the voltage V12 is applied for the time period T12 after the pre-driving voltage V1 is applied for the time period T1. The change rate of the value Epre is calculated from current values at the application voltages V1 and V12, and pre-driving is continued until the change rate reaches 5% or less.

To suppress characteristic changes over time in normal long-period driving, the present invention adopts a condition that the change rate of the field strength equivalent value upon application of an actual use voltage is suppressed to 2% or less. For this purpose, in the above embodiment or following examples of the present invention, pre-driving continues until the change rate of the field strength equivalent value in pre-driving reaches 5% or less, and more preferably 3% or less. The pre-driving execution time for obtaining a given change rate of the field strength equivalent value in pre-driving changes depending on the difference between application voltage magnitudes in pre-driving and actual driving. For example, if the field strength equivalent value in pre-driving is set much higher than that in actual driving, short-time pre-driving can attain a change rate of 2% or less for the field strength equivalent value upon application of an actual use voltage. In this case, however, the device characteristics may greatly degrade, or the device may be destroyed. For this reason, the pre-driving voltage is preferably set such that the change rate of the field strength equivalent value does not extremely exceed 10% at the start of pre-driving.

This voltage application step of the present invention is also effective for electron-emitting devices such as SCE and MIM type electron-emitting devices, in addition to the FE type electron-emitting device.

An SCE (Surface-Conduction) type of electron-emitting device to which the present invention can be applied will be described with reference to FIGS. 5A to 5C.

The basis structures of surface-conduction type of electron-emitting devices to which the present invention can be applied are mainly classified into flat and step electron-emitting devices.

First, a flat surface-conduction type of electron-emitting device will be described.

Figure 5A:
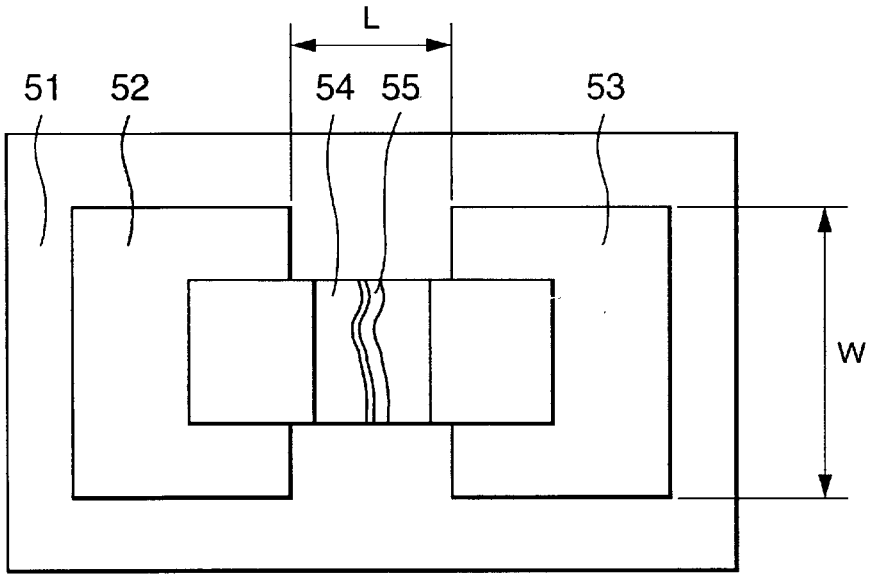
FIGS. 5A to 5C are a schematic plan view and schematic sectional views, respectively, showing an SCE type electron-emitting device to which the present invention can be applied.
Figure 5B:
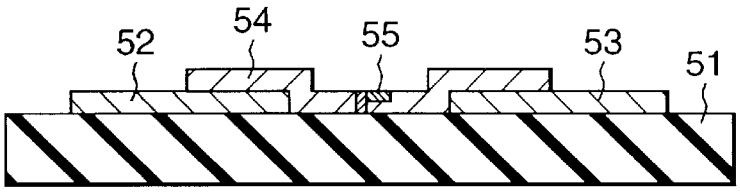
Figure 5C:
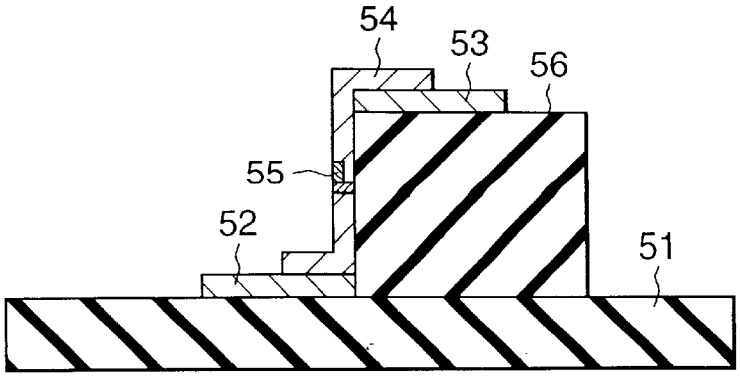

FIGS. 5A to 5C are schematic views showing the structure of a flat surface-conduction type of electron-emitting device to which the present invention can be applied. FIG. 5A is a plan view, and FIG. 5B is a sectional view.

In FIGS. 5A to 5C, reference numeral 51 denotes a substrate; 52 and 53, device electrodes; 54, a conductive thin film; and 55, an electron-emitting portion.

Examples of the substrate 51 are a silica glass substrate, a glass substrate having a low impurity content such as an Na substrate, a soda-lime glass, a glass substrate prepared by stacking an $SiO_2$ layer on a soda-lime glass by sputtering or the like, a ceramics substrate such as an alumina substrate, an Si substrate, and the like.

An example of a material for the facing device electrodes 52 and 53 is a general conductive material. The general conductive material includes metals such as Ni, Cr, Au, Mo, W, Pt, Ti, Al, Cu, and Pd, or alloys of these metals, metals such as Pd, Ag, Au, $RuO_2$, and Pd—Ag, a printed conductor made of a metal oxide and glass or the like, a transparent conductor such as $In_2O_3$—$SnO_2$, and a semiconductor material such as polysilicon.

A device electrode interval L, a device electrode width W, the shape of the conductive thin film 54, and the like are appropriately designed in accordance with an application purpose or the like. The device electrode interval L can be set within the range from several hundred nm to several hundred μm, and preferably the range from several μm to several ten μm.

The device electrode width W can be set within the range from several μm to several hundred μm in consideration of the resistance value of the electrode and electron-emitting characteristics. A film thickness d of the electrodes 52 and 53 can be set within the range from several ten nm to several μm.

Note that the surface-conduction type of electron-emitting device is not limited to the structure shown in FIGS. 5A to 5C, and can be constituted by sequentially stacking the conductive thin film 54 and the facing device electrodes 52 and 53 on the substrate 51.

The conductive thin film 54 preferably comprises a fine particle film made of fine particles in order to obtain good electron-emitting characteristics. The thickness of the conductive thin film 54 is properly set in consideration of step coverage for the device electrodes 52 and 53, the resistance value between the device electrodes 52 and 53, forming conditions (to be described later), and the like. This thickness is set preferably to the range from several hundred pm to several hundred nm, and more preferably to the range from 1 nm to 50 nm. A resistance value Rs is $10^2$ to $10^7$ Ω/__. Note that Rs appears when a resistance R of a thin film having a thickness t, a width w, and a length l is given by R=Rs (l/w). The present specification will exemplify electrification processing as forming processing, but the forming processing is not limited to this and includes processing of forming a fissure in a film and realizing a high-resistance state.

Examples of a material for the conductive thin film 54 are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN and HfN, semiconductors such as Si and Ge, and carbons.

The fine particle film is one containing a plurality of fine particles. As the fine structure, individual fine particles may be dispersed, be adjacent to each other, or overlap each other (including that masses of fine particles form an island structure as a whole). One fine particle has a diameter within the range from several multiples of 0.1 nm to several hundred nm, and preferably the range from 1 nm to 20 nm.

The electron-emitting portion 55 has a high-resistance fissure formed at part of the conductive thin film 54. The electron-emitting portion 55 depends on the thickness, quality, and material of the conductive thin film 54, a forming method (to be described later), and the like. The electron-emitting portion 55 may contain conductive fine particles each having a diameter within the several multiples of 0.1 nm to several ten nm. The conductive fine particles contain some or all of elements of a material forming the conductive thin film 54. Carbon and a carbon compound are contained in the electron-emitting portion 55 and the neighboring conductive thin film 54.

Next, a step surface-conduction type of electron-emitting device will be described.

FIG. 5C is a schematic view showing an example of a step surface-conduction type of electron-emitting device to which the surface-conduction type of electron-emitting device of the present invention can be applied.

In FIG. 5C, the same reference numerals as in FIGS. 5A and 5B denote the same parts. Reference numeral 56 denotes a step-forming member. A substrate 51, device electrodes 52 and 53, a conductive thin film 54, and an electron-emitting portion 55 can be made of the same materials as in the above-mentioned flat surface-conduction type of electron-emitting device. The step-forming member 56 can be made of an insulating material such as $SiO_2$ formed by vacuum evaporation, printing, sputtering, and the like. The thickness of the step-forming member 56 corresponds to the device electrode interval L of the flat surface-conduction type of electron-emitting device and can be set within the range from several hundred nm to several ten $\mu$m. This thickness is set in consideration of the manufacturing method of the step-forming member and a voltage applied between the device electrodes, and preferably set within the range from several ten nm to several $\mu$m.

After the device electrodes 52 and 53 and step-forming member 56 are formed, the conductive thin film 54 is stacked on the device electrodes 52 and 53. In FIG. 5C, the electron-emitting portion 55 is formed on the step-forming member 56. The electron-emitting portion 55 depends on manufacturing conditions, forming conditions, and the like, and its shape and position are not limited to those in FIG. 5C.

The surface-conduction type of electron-emitting device can be manufactured by various methods, and an example of the methods is schematically shown in FIGS. 6A to 6D.

An example of the manufacturing method will be explained with reference to FIGS. 5A, 5B, and 6A to 6D. Also in FIGS. 6A to 6D, the same reference numerals as in FIGS. 5A and 5B denote the same parts.

Figure 6A:
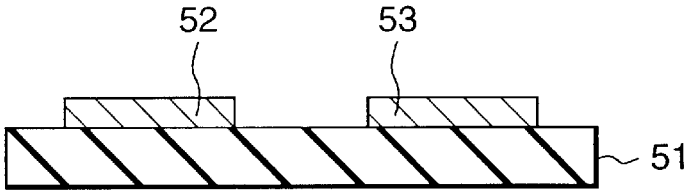
FIGS. 6A to 6D are views showing the steps in manufacturing the SCE type electron-emitting device to which the present invention can be applied.

1) A substrate 51 is satisfactorily cleaned with a detergent, pure water, an organic solvent, or the like, and a device electrode material is deposited by vacuum evaporation, sputtering, or the like to form device electrodes 52 and 53 on the substrate 51 by, e.g., photolithography (FIG. 6A).

Figure 6B:
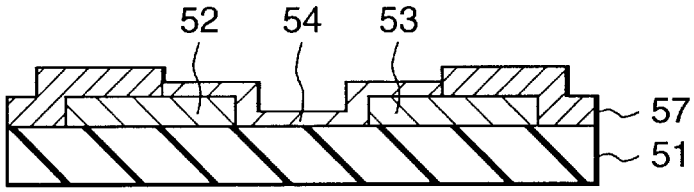
Figure 6C:
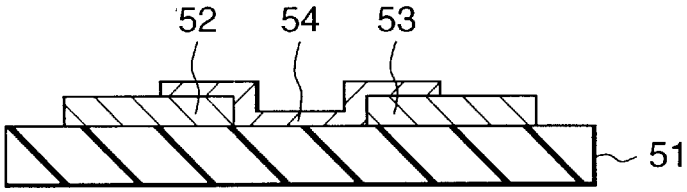

2) The substrate 51 having the device electrodes 52 and 53 is coated with an organic metal solvent to form an organic metal thin film. As the organic metal solvent, an organic metal compound solvent containing a metal of a material for the conductive thin film 54 as a main element can be used. The organic metal thin film is heated, sintered, and patterned into a conductive thin film 54 by etching, or lift-off using a mask 57 corresponding to the conductive thin film shape, as shown in FIG. 6B (FIG. 6C). Although the coating method of the organic metal solvent has been exemplified, the formation method of the conductive thin film 54 is not limited to this, and can be vacuum evaporation, sputtering, chemical vapor deposition, dispersion coating, dipping, spinner method, or the like. Alternatively, the conductive thin film 54 can be directly patterned by an ink-jet method or the like.

3) The obtained device undergoes a forming step. As an example of the forming method, an electrification method in a vacuum vessel will be described with reference to FIG. 6D.

Figure 6D:
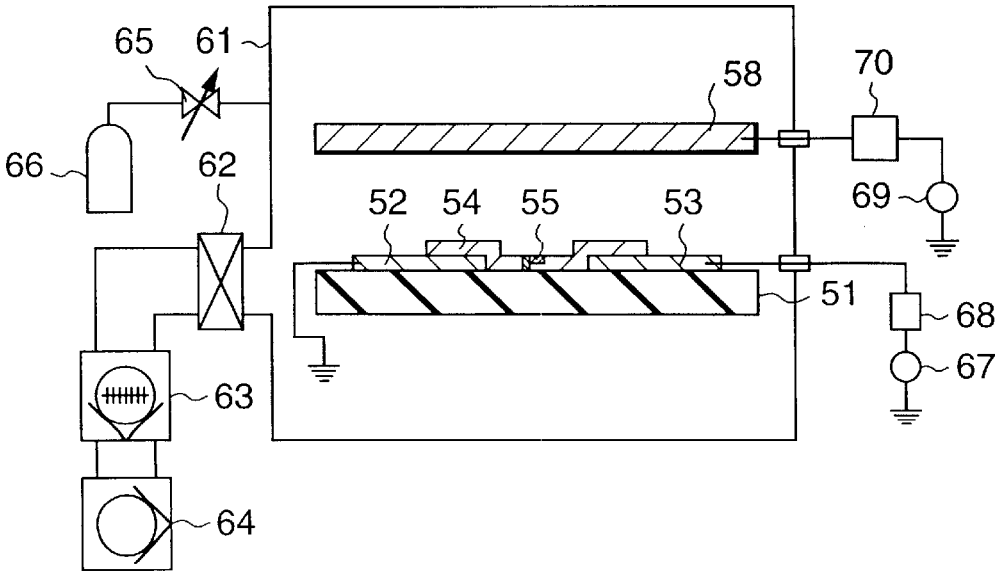

In FIG. 6D, reference numeral 61 denotes a vacuum vessel which is evacuated through a gate valve 62 by a vacuum pump 63 such as a turbo molecular pump, sputter-ion pump, or cryopump. If necessary, the vacuum pump 63 is connected to an auxiliary pump 64 such as a scroll pump, rotary pump, or sorption pump. Reference numeral 66 denotes a container for containing activation gas used in an activation step (to be described below) The container 66 is connected to the vacuum vessel 61 through an adjustment valve 65 such as a variable-leakage valve or needle valve.

The device electrodes 52 and 53 are connected to a voltage application means. For example, as shown in FIG. 6D, the device electrode 52 is connected to a ground potential, and the device electrode 53 is connected to a power supply 67 through a current supply terminal. To monitor a current value flowing between the device electrodes 52 and 53, an ammeter 68 is connected. Reference numeral 58 denotes an anode electrode used in a subsequent step. The anode electrode 58 is connected to a high-voltage power supply 69 through an ammeter 70.

Figure 7A:
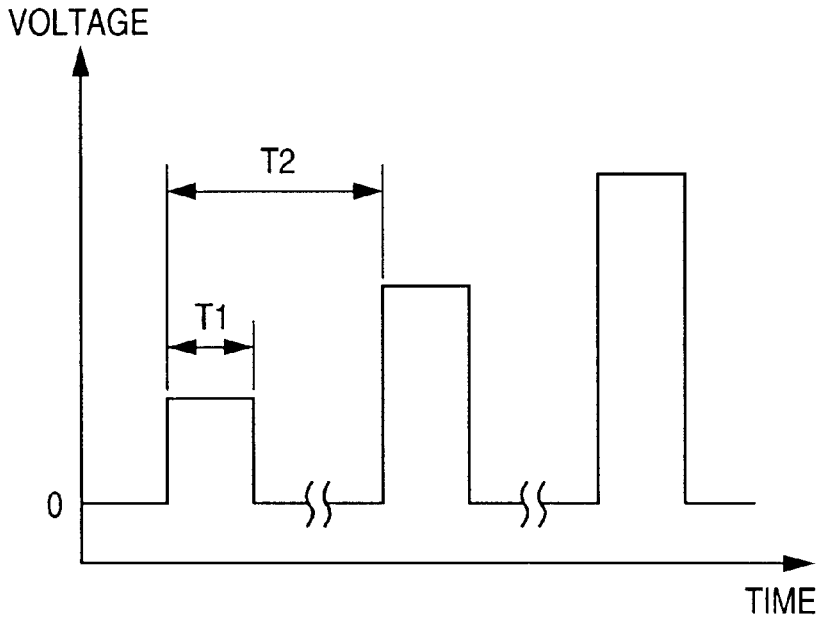
FIGS. 7A and 7B are graphs each showing a voltage pulse used during the manufacturing process of the SCE type electron-emitting device to which the present invention can be applied.
Figure 7B:
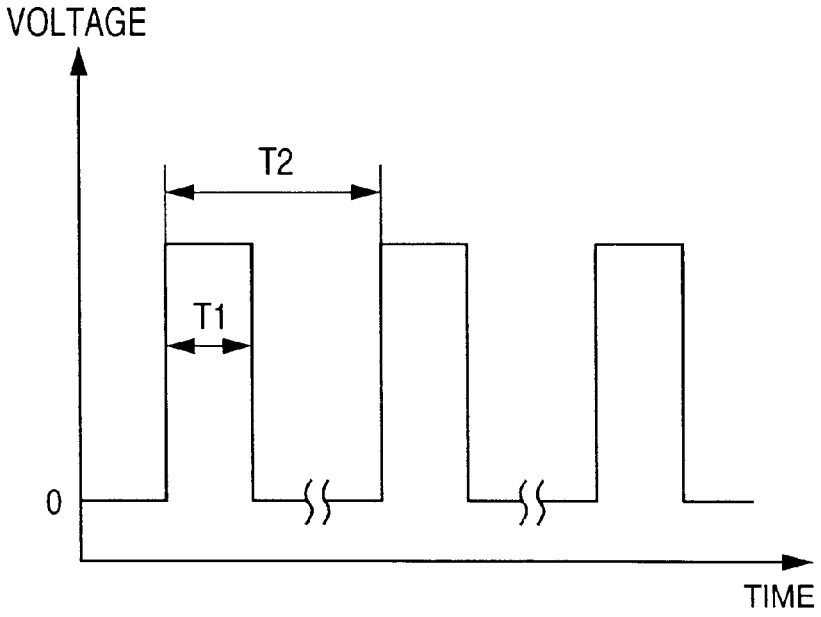

After the vacuum vessel is evacuated, the device electrodes 52 and 53 are electrified using the power supply 67 to form an electron-emitting portion 55 having a changed structure at a portion of the conductive thin film 54 (FIG. 6D). According to forming processing, a structure-changed portion such as a locally destructed, deformed, or quality-changed portion is formed in the conductive thin film 54. This portion functions as the electron-emitting portion 55. FIGS. 7A and 7B show examples of a forming voltage waveform.

This voltage waveform is preferably a pulse waveform. Pulses can be applied by a method, FIG. 7A, of applying voltage pulses while increasing the pulse peak value, or a method, FIG. 7B, of successively applying pulses whose peak value is a constant voltage.

T1 and T2 in FIG. 7A represent the pulse width and interval of the voltage waveform, respectively. In general, T1 is set within the range from 1 $\mu$sec to 10 msec, and T2 is set within the range from 10 $\mu$sec to 1 sec. The pulse peak value can be increased every step of, e.g., about 0.1 V. The end of forming processing can be determined by detecting a change in resistance value caused when the conductive thin film 52 is locally destructed or deformed. For example, the end of forming processing can be detected by applying a voltage so as not to locally destruct or deform the conductive thin film 52 during the pulse interval T2 and measuring the current. A device current flowing upon application of a voltage of about 0.1 V is measured to obtain the resistance value, and when the resistance value exhibits 1 MΩ or more, forming processing is completed.

The pulse waveform is not limited to a rectangular waveform, and can adopt a desired waveform such as a triangular waveform.

T1 and T2 in FIG. 7B can be set similarly to those shown in FIG. 7A. The pulse peak value is appropriately selected in accordance with the structure of the surface-conduction type of electron-emitting device. Under these conditions, a voltage is applied for, e.g., several sec to several ten min. The pulse waveform is not limited to a rectangular waveform, and can adopt a desired waveform such as a triangular waveform. By this step, a gap is formed in the conductive film.

4) The device having undergone forming processing is preferably subjected to processing called an activation step. In the activation step, a device current If and an emission current Ie greatly change.

Similar to forming processing, the activation step is executed by repeatedly applying pulses in an atmosphere containing an organic substance gas. This atmosphere can be formed using an organic gas left in an atmosphere when the vacuum vessel is evacuated with an oil diffusion pump, rotary pump, or the like, or using a proper organic substance gas introduced into a vacuum in the vacuum vessel temporarily sufficiently evacuated by an ion pump or the like. The gas pressure of a preferable organic substance changes depending on the application purpose of the device, the shape of the vacuum vessel, the kind of organic substance, and the like, and is appropriately set in accordance with them. Examples of the proper organic substance are aliphatic hydrocarbons such as alkane, alkene, alkyne, aromatic hydrocarbons, alcohols, aldehydes, ketones, amines, phenol, and organic acids such as carboxylic acid and sulfonic acid. Detailed examples are saturated hydrocarbons such as methane, ethane, and propane, unsaturated hydrocarbons such as ethylene and propylene, butadiene, n-hexane, 1-hexene, benzene, toluene, o-xylene, benzonitrile, trinitrile, chloroethylene, trichloroethylene, methanol, ethanol, isopropanol, formaldehyde, acetaldehyde, acetone, methyl ethyl ketone, diethyl ketone, methyl amine, ethyl amine, acetic acid, propionic acid, and a mixture of them. By this processing, carbon or a carbon compound is deposited on the device, and particularly in the gap from the organic substance present in the atmosphere. As a result, the device current If and emission current Ie greatly change.

The end of the activation step is determined while measuring the device current If and emission current Ie. Note that the pulse width, pulse interval, pulse peak value, and the like are appropriately set.

5) The electron-emitting device obtained by these steps is desirably subjected to a stabilization step. In this step, the organic substance in the vacuum vessel is exhausted. An evacuation apparatus for evacuating the vacuum vessel is preferably one not using any oil so as not to affect device characteristics by an organic substance such as oil produced by the apparatus. For example, this evacuation apparatus is a magnetic levitation type turbo molecular pump, cryopump, sorption pump, ion pump, or the like.

When the activation step uses an oil diffusion pump or rotary pump as an exhaust device, and uses an organic gas originating from an oil component produced by the pump, the partial pressure of the component must be suppressed as low as possible. The partial pressure of the organic component in the vacuum vessel is preferably $1\times10^{-6}$ Pa or less, and more preferably $1\times10^{-8}$ Pa or less so as not to newly deposit any carbon or carbon compound. In evacuating the vacuum vessel, the whole vacuum vessel is preferably heated to facilitate exhaustion of organic substance molecules attached to the inner wall of the vacuum vessel and the electron-emitting device. This heating is desirably done at a temperature of 80 to 250° C. and preferably 150° C. or more for a time as long as possible. However, the heating conditions are not particularly limited to them. Heating is performed under conditions properly selected in consideration of various conditions such as the size and shape of the vacuum vessel and the structure of the electron-emitting device. The internal pressure of the vacuum vessel must be minimized, and is preferably $1\times10^{-5}$ Pa or less, and more preferably $1\times10^{-6}$ Pa or less.

A drive atmosphere after the stabilization step preferably maintains an atmosphere at the end of the stabilization step, but is not limited to this. As far as the organic substance is satisfactorily removed, stable characteristics can be maintained to a certain degree even if the pressure of the vacuum vessel slightly rises.

By adopting such vacuum atmosphere, deposition of new carbon or carbon compound can be suppressed, and $H_2O$ and $O_2$ attached to the vacuum vessel and substrate can be removed. As a result, the device current If and emission current Ie relatively stabilize.

The basic characteristics of the electron-emitting device obtained by the above steps to which the present invention can be applied will be described with reference to FIG. 8.

Figure 8:
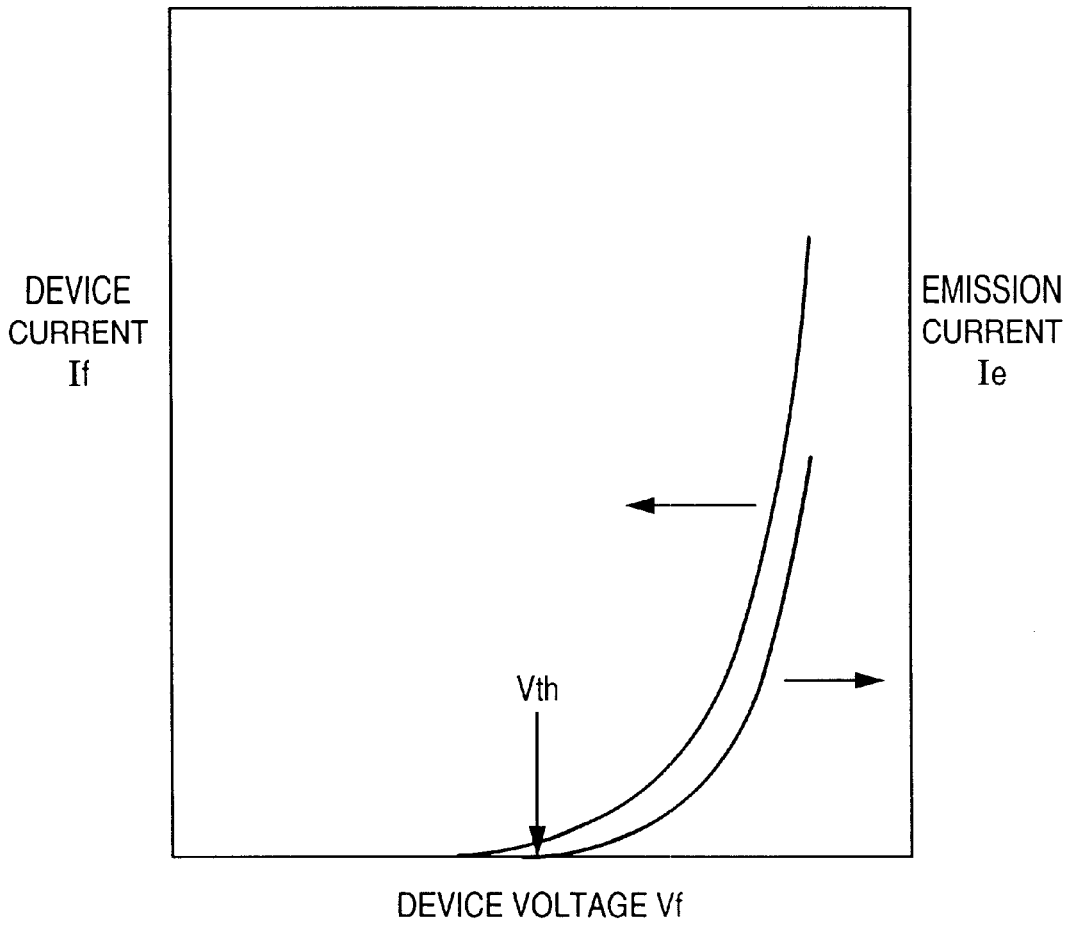
FIG. 8 is a graph showing the electrical characteristics of the SCE type electron-emitting device to which the present invention can be applied.

FIG. 8 is a graph schematically showing the relationship between the emission current Ie, device current If, and device voltage Vf measured using the vacuum processing device shown in FIG. 6D. In measurement, a high voltage was applied from the high-voltage power supply 69 to the anode electrode 58 arranged above the electron-emitting device. For example, measurement can be done at an anode electrode voltage of 1 kV to 10 kV, and a distance H of 2 mm to 8 mm between the anode electrode and the electron-emitting device. In FIG. 8, since the emission current Ie is much smaller than the device current If, they are given in arbitrary units. Note that both the ordinate and abscissa are based on linear scales.

As is apparent from FIG. 8, the electron-emitting device to which the present invention can be applied has three characteristic features regarding the emission current Ie:

(i) The emission current Ie abruptly increases when a device voltage of a predetermined level (to be referred to as a threshold voltage: Vth in FIG. 8) or higher is applied to the device, but almost no emission current Ie is detected when the voltage is equal to or lower than the threshold voltage Vth. The device is a nonlinear device having a clear threshold voltage Vth with respect to the emission current Ie.

(ii) The emission current Ie can be controlled by the device voltage Vf because the emission current Ie linearly depends on the device voltage Vf.

(iii) Emission charges captured by the anode electrode 58 depend on the application time of the device voltage Vf. In other words, a charge amount captured by the anode electrode 58 can be controlled by the application time of the device voltage Vf.

As is apparent from the above description, the electron-emitting characteristics of the surface-conduction type of electron-emitting device to which the present invention can be applied can be easily controlled in accordance with an input signal. By using this property, the surface-conduction type of electron-emitting device can be applied to various devices such as an electron source constituted by arranging a plurality of electron-emitting devices, and an image forming device.

The relationship between the emission current Ie and the device voltage Vf for the surface-conduction type of electron-emitting device to which the present invention can be applied is plotted on the graph shown FIG. 1 to exhibit a characteristic which can be approximated by an almost straight line. For the device current, the relationship between If and Vf is plotted on the graph of FIG. 1 to exhibit a characteristic having a region which can be approximated by a straight line, as represented by a continuous line in FIG. 1.

Pre-driving for the surface-conduction type of electron-emitting device can also employ the similar method to the FE type electron-emitting device.

Figure 9:
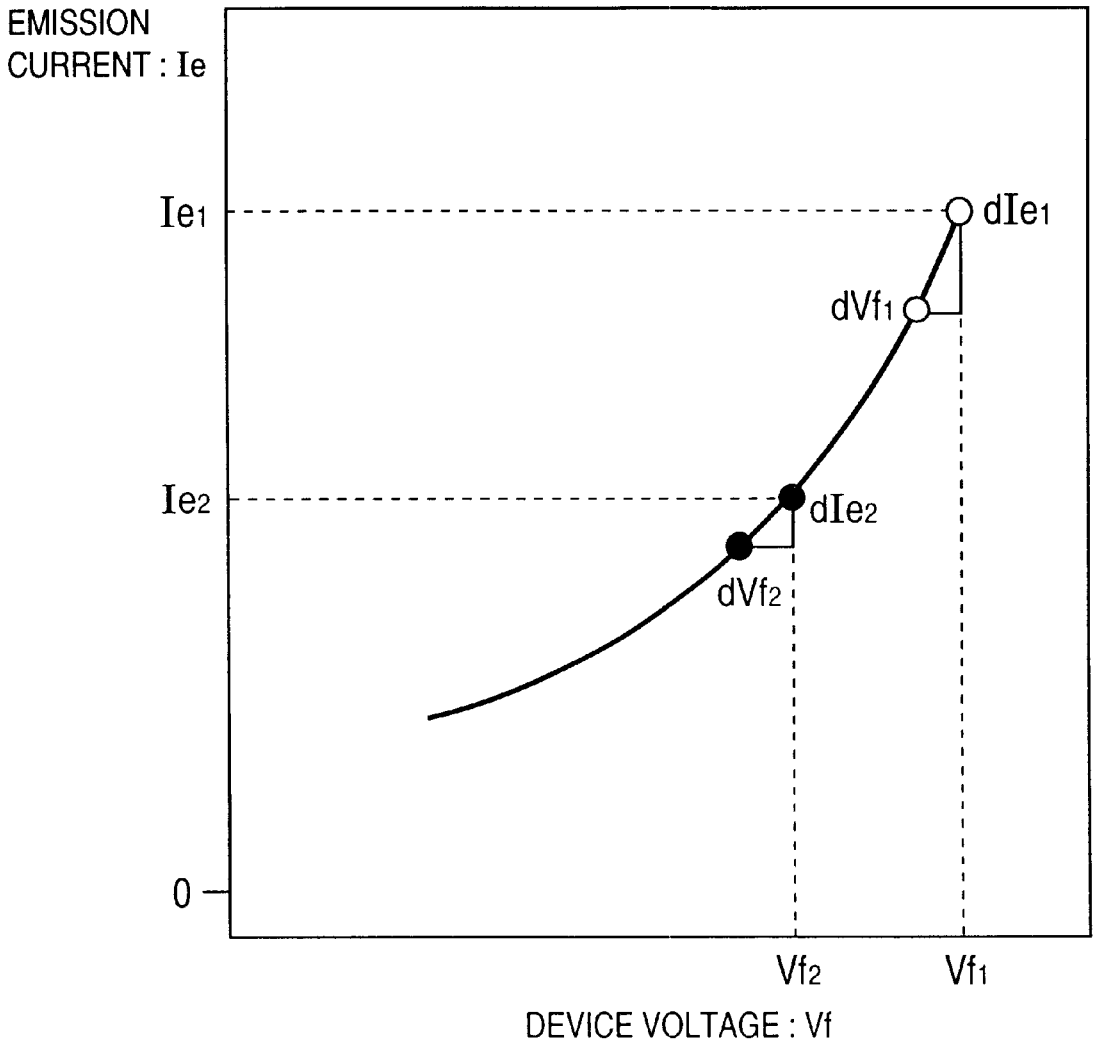
FIG. 9 is a graph showing the relationship between the emission current and device voltage of an electron-emitting device formed in Example 3.

In this case, as shown in FIG. 9, the voltages V1 and V2 in the inequalities (8) and (9) are replaced by device voltages Vf1 and Vf2. Similarly, the emission currents are replaced by Ie1 and Ie2.

When the surface-conduction type of electron-emitting device is used, not only the relationship between the driving voltage and the emission current, but also the relationship between the driving voltage and the device current can be used as a reference for setting pre-driving conditions.

Figure 10:
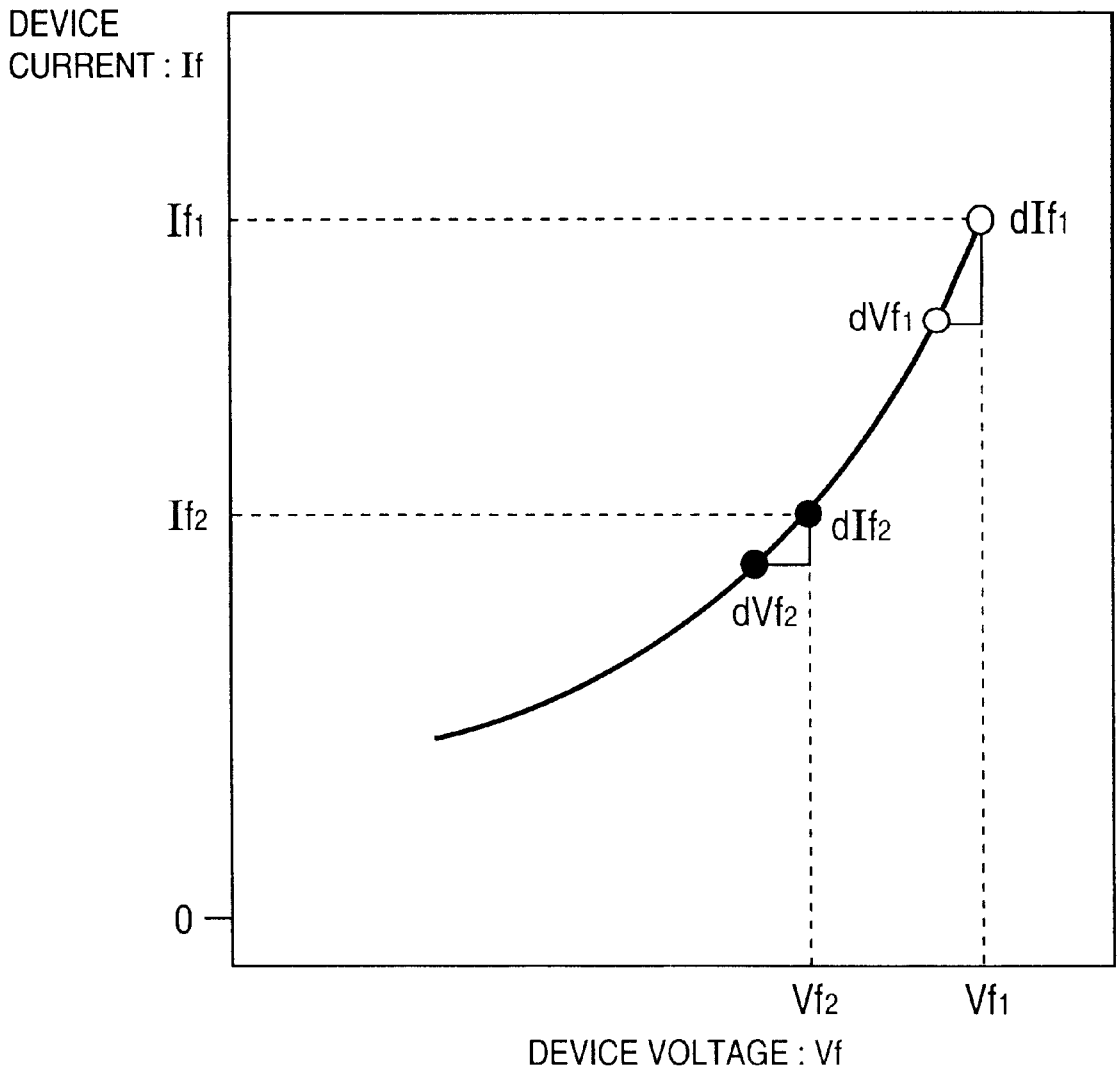
FIG. 10 is a graph showing the relationship between the device current and device voltage of an electron-emitting device formed in Example 2.

In this case, as shown in FIG. 10, the voltages V1 and V2 in the inequalities (8) and (9) are replaced by the device voltages Vf1 and Vf2. Similarly, the device currents are replaced by If1 and If2.

Figure 12:
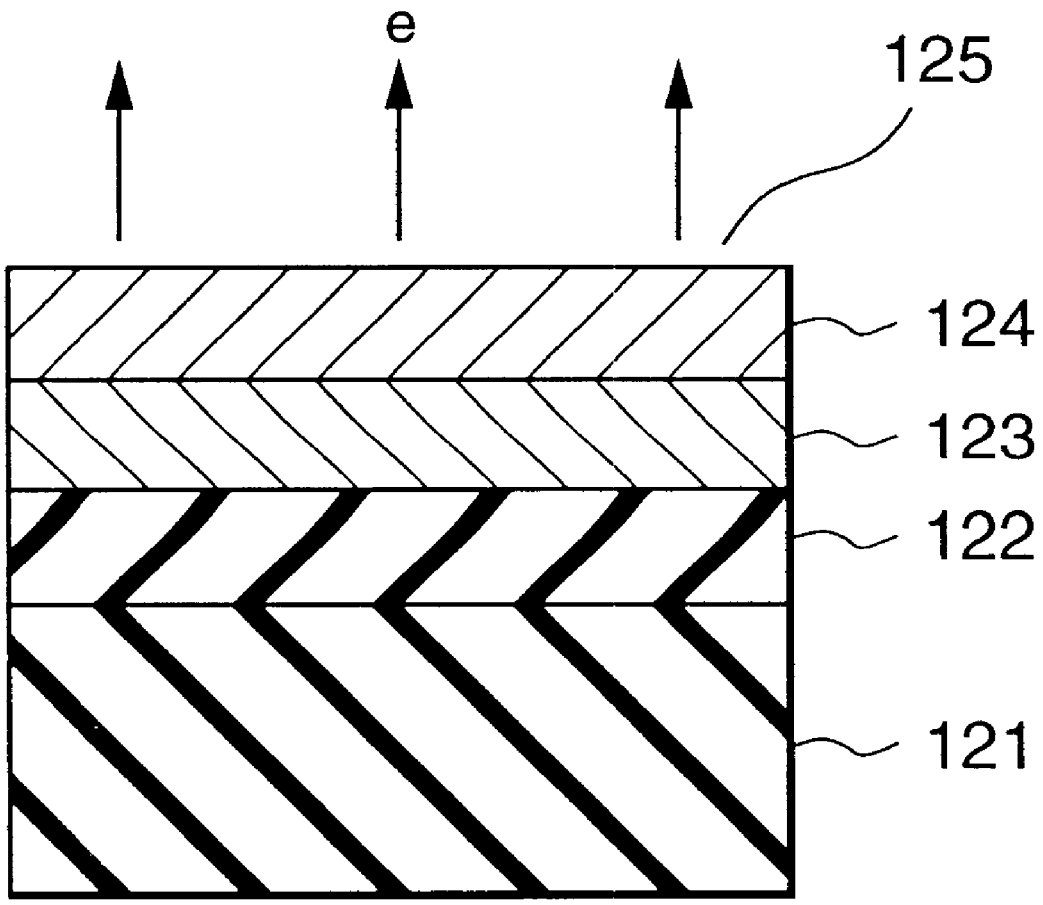
FIG. 12 is a schematic sectional view showing an MIM type electron-emitting device to which the present invention can be applied.

The voltage application step of the present invention can also be applied to an MIM type electron-emitting device as shown in FIG. 12.

In FIG. 12, reference numeral 121 denotes a substrate; 122, a lower electrode; 123, an insulating thin film; 124, an upper electrode; and 125, an electron-emitting portion.

By applying a voltage between the lower and upper electrodes 122 and 124, electrons emitted by the lower electrode 122 are accelerated within the insulating thin film 123, and emitted from the electron-emitting portion 125 through the upper electrode 124.

A method of manufacturing the MIM type electron-emitting device will be briefly described.

A metal material is deposited on a substrate 122 by a film formation method such as vapor deposition or sputtering, thereby forming a lower electrode 122.

By the same film formation method, an insulating thin film 123 is formed on the lower electrode 122. Examples of a material for the insulating thin film 123 are oxides such as $Al_2O_3$, $MnO_2$, and $SiO_2$, halides such as LiF, KF, $MgF_2$, and NaBr, and sulfides such as ZnS and CdS. A proper film thickness of the insulating thin film 123 is several nm to several hundred nm.

By the same film formation method as described above, an upper electrode 124 is formed on the insulating thin film 123. Examples of a material for the upper electrode 124 are Au, Cu, Ag, and Al. After the MIM type electron-emitting device is formed in this manner, forming processing is done by applying a voltage between the lower and upper electrodes 123 and 124 so as to make the upper electrode 124 positive. By this forming processing, the electron-emitting portion 125 emits electrons.

Also in the MIM type electron-emitting device, the voltage applied between the upper and lower electrodes, the emission current emitted from the electron-emitting portion between the two electrodes, and the diode current flowing through the two electrodes exhibit the same relationships as in FIGS. 9 and 10. Therefore, the MIM type electron-emitting device can be pre-driven by the same method as for the FE and SCE type electron-emitting devices.

Note that pre-driving is executed in the last stage of the manufacturing process, e.g., after or during the stabilization step. Alternatively, pre-driving can be done as a refresh step before shipping after stock, or as a proper refresh mode after the electron-emitting device is used.

EXAMPLES

Examples of the present invention will be described. However, the present invention is not limited to these examples, and incorporates replacement of respective elements and design change as far as the object of the present invention is achieved.

Example 1

In Example 1, the voltage application step (pre-driving) of the present invention is applied to an FE type electron-emitting device having the same structure as that schematically shown in FIG. 2. A plurality of electron-emitting devices (devices A, B, C, D, and E) were manufactured by the following steps. The electron-emitting device manufacturing method used in Example 1 will be explained with reference to FIGS. 3A to 3E.

Figure 3A:
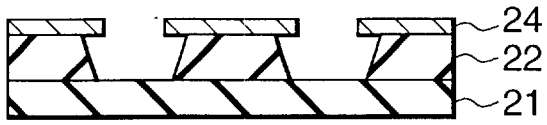
FIGS. 3A to 3E are views showing the steps in manufacturing the FE type electron-emitting device to which the present invention can be applied.

Step-1a (FIG. 3A)

A 1.5-$\mu$m thick insulating layer 22 of silicon oxide was formed on a cleaned silicon substrate 21 by thermal oxidization, and a 0.4-$\mu$m thick molybdenum film was formed by electron beam deposition. A resist (PMM: Poly-Methyl-Methacrylate) was applied to the molybdenum film, and irradiated with a converged electron beam to form a pattern corresponding to the opening of a gate electrode. A 1.5-$\mu$m $\phi$ opening was formed in the gate electrode material by etching, thereby forming a gate electrode 24. The insulating layer 22 at a position corresponding to the opening of the gate electrode 24 was removed with buffer hydrofluoric acid. In Example 1, a total of nine gate electrode openings were formed.

Figure 3B:
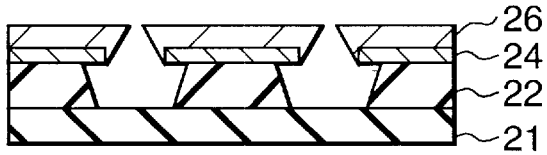

Step-1b (FIG. 3B)

The resist pattern was removed, and aluminum 26 was diagonally deposited while the substrate was rotated in the vacuum evaporator.

Figure 3C:
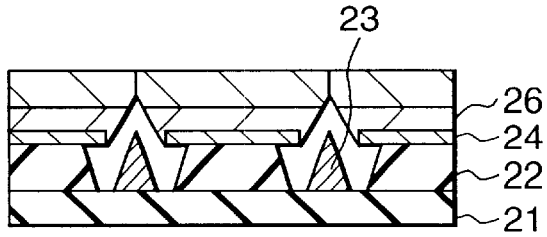

Step-1c (FIG. 3C)

Molybdenum was vertically deposited on the substrate to form a cathode 23.

Figure 3D:
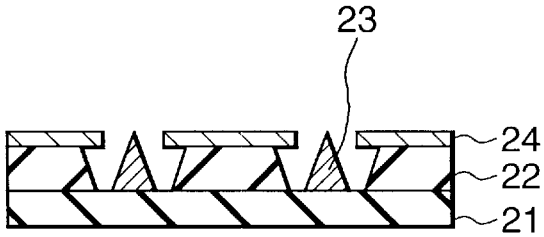

Step-1d (FIG. 3D)

The aluminum 26 and molybdenum deposited on the gate electrode 24 were removed to complete an FE type electron-emitting device.

The electron-emitting device completed in this manner was set in a vacuum vessel, and underwent pre-driving of the present invention to check electron-emitting characteristics.

Figure 3E:
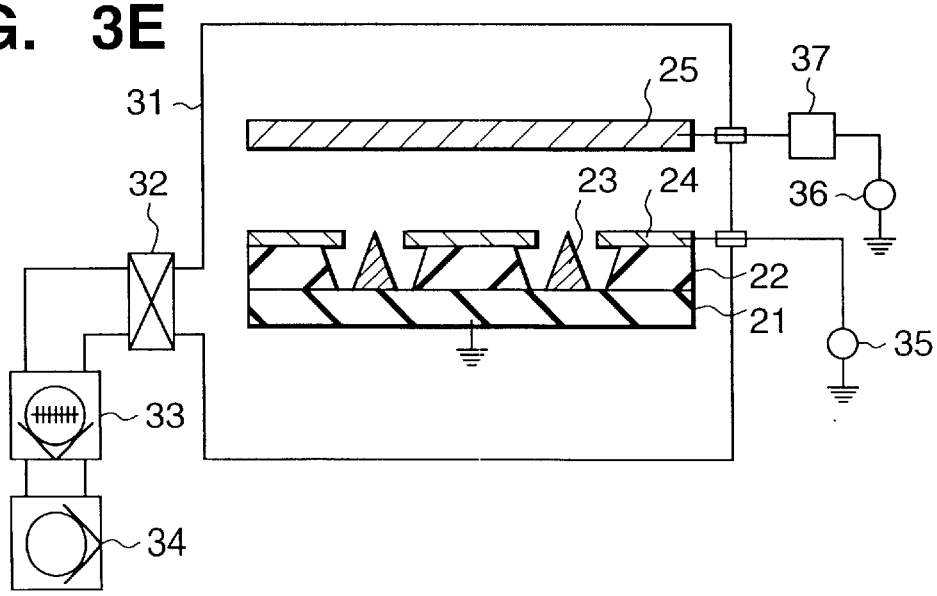

FIG. 3E is a sectional view schematically showing this state. Reference numerals 21 to 24 denote the components of the electron-emitting device formed up to step-1d. Reference numeral 25 denotes an anode electrode arranged 5 mm above the electron-emitting device. The anode electrode is constituted by forming an ITO transparent electrode and fluorescent substances on a glass substrate. Reference numeral 31 denotes a vacuum vessel which is evacuated by a turbo molecular pump 33 through a gate valve 32. The turbo molecular pump is evacuated by a scroll pump 34. In the electron-emitting device, the electrode 21 made from the silicon substrate is connected to a ground potential, the gate electrode 24 is connected to a power supply 35 through a current supply terminal, and the anode electrode 25 is connected to a high-voltage power supply 36 through a current supply terminal. An emission current flowing through the anode electrode is measured by an ammeter 37.

In the arrangement shown in FIG. 3E, the vacuum vessel 31 was evacuated to an internal pressure of $1\times10^{-4}$ Pa, and the whole vacuum vessel 31 and electron-emitting device were temporarily heated to 250° C. for 10 hrs using a heater (not shown). The vacuum vessel 31 was kept evacuated to set the internal pressure of the vacuum vessel at room temperature to about $1\times10^{-7}$ Pa.

After the internal pressure of the vacuum vessel was adjusted, pre-driving as the feature of the present invention was performed.

In pre-driving, the anode voltage was set to 1,000 V, two different voltages were applied to the gate electrode, and electrical characteristics at two comparison points (○ and ● in FIG. 4) on the plot of FIG. 4 were obtained.

More specifically, an emission current value I1 flowing at V1=200 V, and a change amount dI1 of current flowing when V1 was changed by dV1=10 V were obtained. A differential coefficient dI1/dV1 of the current at the voltage V1 was calculated. Similarly, an emission current I2 flowing at a voltage V2=160 V different from V1, and dI2 for dV2=5 V were obtained. A differential coefficient dI2/dV2 of the current at the voltage V2 was calculated. Consequently, a relation:

$$I1/(V1dI1/dV1-2\cdot I1)>I2/(V2\cdot dI2/dV2-2\cdot I2)$$

was obtained, and V1 was adopted as the pre-driving voltage Vpre.

At the obtained pre-driving voltage Vpre=200 V, the electron-emitting devices (devices A, B, C, and D) were pre-driven. At this time, the driving voltage waveform was a waveform shown in FIG. 11B, and V1=200 V, V12=190 V, T1=0.2 msec, T12=0.05 msec, and the pulse interval T2=16.7 msec were used.

During pre-driving, the current I1 at V1 and the current I12 at V12 were measured. From the difference dI1 between I1 and I12, and the difference dV1 between V1 and V12, $$Epre=I1/(V1\cdot dI1/dV1-2\cdot I1)$$

was calculated to perform pre-driving.

Pre-driving continued until the change rate of the value Epre reached about 10% for the device A, until the change rate of the value Epre reached about 7% for the device B, until the change rate of the value Epre reached about 5% for the device C, and until the change rate of the value Epre reached about 3% for the device D. No pre-driving was done for the device E.

The voltage was set to V2=160 V, and the devices were driven for a long time. Changes over time and variations in emission current during driving were the largest in the device E not pre-driven, and the second and third largest in the devices A and B. In the devices C and D, the emission current during driving hardly decreased and varied, and stable electron-emitting characteristics were attained.

A 160-V voltage pulse was applied to the devices C and D successively twice, and their field strength equivalent values were checked to find that the change rates of the field strength equivalent values were 2% or less. In particular, the device D exhibited a change rate lower than 1%.

Example 2

In Example 2, the voltage application step of the present invention is applied to an SCE type electron-emitting device having the same structure as that schematically shown in FIGS. 5A to 5C. A plurality of electron-emitting devices (devices F, G, H, I, and J) were manufactured by the following steps. The electron-emitting device manufacturing method used in Example 2 will be explained with reference to FIGS. 6A to 6D.

Step-3a (FIG. 6A)

A quartz substrate 51 was cleaned, and Ti and Pt were deposited on the substrate 51 to thicknesses of 5 nm and 50 nm, respectively. A photoresist was applied to the deposition film to form a pattern conforming to a pair of device electrodes 52 and 53. Pt and Ti were etched away from unwanted portions, and the resist was removed to form device electrodes 52 and 53 on the substrate 51. Note that an interval L between the device electrodes 52 and 53 was 10 μm, and a length W of the device electrode was 300 μm. ps Step-3b (FIG. 6B)

A 50-nm thick Cr film was deposited by vacuum deposition on the substrate 51 having the device electrodes 52 and 53. An opening corresponding to the prospective formation portion of a conductive thin film was formed in the Cr film by photolithography. An organic Pd compound solution (ccp-4230: available from Okuno Seiyaku KK) was applied, and the resultant structure was heated in atmosphere at 300° C.

Step-3c (FIG. 6C)

The Cr film formed in step-3b was wet-etched. The structure was cleaned with pure water and dried to form a conductive thin film 54.

The following steps were performed after the electron-emitting device during the manufacturing process was set in a vacuum vessel and electrically connected, as shown in FIG. 6D.

As shown in FIG. 6D, the device electrode 52 was connected to the ground potential, and the device electrode 53 was connected to an ammeter 68 and device voltage power supply 67 through a current supply terminal. An anode electrode 58 was arranged 5 mm above the substrate 51. The anode electrode 58 was connected to an ammeter 70 and high-voltage power supply 69 through a current supply terminal.

Step-3d

The vacuum vessel 61 was evacuated to about $1\times10^{-3}$ Pa or less using a scroll pump 64 and turbo molecular pump 63. The device electrode 53 received a voltage generated by the device voltage power supply 67 serving as a means for applying a potential to one of the two electrodes constituting the device, thereby applying a voltage between the two electrodes. Forming processing was done to form an electron-emitting portion 55. The applied voltage was a pulse-like voltage as shown in FIG. 7A, which asymptotically increased its peak value with the lapse of time. The pulse width T1 was 1 msec, and the pulse interval T2 was 16.7 msec. When the pulse peak value reached 6 V during forming processing, a current value flowing through the ammeter 68 greatly decreased. The pulse voltage was kept applied until the pulse peak value reached 6.5 V. After that, application of the voltage was stopped. The resistance value between the device electrodes 52 and 53 was measured to exhibit 1 MΩ or more. Thus, forming processing ended.

Step-3e

The vacuum vessel 61 was kept evacuated to decrease its internal pressure to $10^{-5}$ Pa or less. A variable-leakage valve 65 was adjusted to introduce benzonitrile gas from an activation gas container 66 to the vacuum vessel 61, thereby performing the activation step. In the activation step, the internal pressure of the vacuum vessel containing the activation gas was adjusted to $10^{-4}$ Pa, and a voltage generated by the device voltage power supply 67 was applied to the device electrode 53. The applied voltage was a pulse-like voltage as shown in FIG. 7B, which had a constant peak value. The pulse peak value was 16 V, the pulse width T1 was 1 msec, and the pulse interval T2 was 16.7 msec. After activation processing continued one hour, application of the voltage was stopped, introduction of the activation gas was stopped, and the activation gas was exhausted from the vacuum vessel.

Step-3f

The whole vacuum vessel 61 and electron-emitting device were temporarily heated to 250° C. for 10 hrs using a heater (not shown). The vacuum vessel was kept evacuated to set the internal pressure of the vacuum vessel at room temperature to about $1\times10^{-7}$ Pa.

After the internal pressure of the vacuum vessel was adjusted, pre-driving as the feature of the present invention was performed.

In pre-driving, the anode voltage was set to 0 V, two different voltages were applied to the device electrode 53, and electrical characteristics at two comparison points (○ and ● in FIG. 10) on the plot of FIG. 10 were obtained.

More specifically, a device current value If1 flowing at Vf1=16.0 V, and a change amount dIf1 of current flowing when Vf1 was changed by dVf1=0.2 V were obtained. A differential coefficient dIf1/dVf1 of the current at the voltage Vf1 was calculated. Similarly, a device current If2 flowing at a voltage Vf2=14.5 V different from Vf1, and dIf2 for dVf2=0.2 V were obtained. A differential coefficient dIf2/dVf2 of the current at the voltage Vf2 was calculated. Consequently, a relation:

$$If1/(Vf1\cdot dIf1/dVf1-2\cdot If1)>If2/(Vf2\cdot dIf2/dVf2-2\cdot If2)$$

was obtained, and Vf1 was adopted as the pre-driving voltage Vpre.

At the obtained pre-driving voltage Vpre=16 V, the electron-emitting devices (devices F, G, H, and I) were pre-driven. At this time, the driving voltage waveform was a waveform shown in FIG. 11B, and V1=16 V, V12=15.7 V, T1=0.5 msec, T2=0.05 msec, and the pulse interval T3=16.7 msec were used.

During pre-driving, the current I1 at V1 and the current I12 at V12 were measured. While Epre=I1/(V1·dI1/dV1−2·I1) was calculated from the difference dI1 between I1 and I12, and the difference dV1 between V1 and V12, pre-driving was executed.

Pre-driving continued until the change rate of the value Epre reached about 10% for the device F, until the change rate of the value Epre reached about 7% for the device G, until the change rate of the value Epre reached about 5% for the device H, and until the change rate of the value Epre reached about 3% for the device I. No pre-driving was done for the device J.

The driving voltage V2 was set to 14.5 V, the anode voltage was set to 1,000 V, and the devices were driven for a long time. Changes over time and variations in emission current during driving were the largest in the device J not pre-driven, and the second and third largest in the devices F and G. In the devices H and I, the emission current during 62 driving hardly decreased and varied, and stable electron-emitting characteristics were attained.

A 14.5-V voltage pulses was applied to the devices H and I successively twice, and their field strength equivalent values were checked to find that the change rates of the field strength equivalent values were 1% or less.

Example 3

Example 3 used electron-emitting devices (devices K, L, M, N, and O) prepared with the same structure by the same manufacturing method as those of the electron-emitting devices prepared in Example 2.

These electron-emitting devices were set in a proper vacuum atmosphere, and underwent the following processing, similar to Example 2.

In pre-driving, the anode voltage was set to 1,000 V, two different voltages were applied to a device electrode 53, and electrical characteristics at two comparison points (○ and ● in FIG. 9) on the plot of FIG. 9 were obtained. Note that the method of deriving the differential coefficient of an emission current corresponding to the application voltage was the same as in Example 2 except that the emission current replaced the device current, and a description thereof will be omitted.

A device current Ie1 flowing at Vf1=15.5 V, and the differential coefficient of the emission current were obtained. A device current Ie2 flowing at Vf2=14.3 V, and the differential coefficient of the emission current were obtained. As a result, a relation:

$$Ie1/(Vf1\cdot dIe1/dVf1-2\cdot Ie1)>Ie2/(Vf2\cdot dIe2/dVf2-2\cdot Ie2)$$

was obtained, and Vf1 was adopted as the pre-driving voltage Vpre.

At the obtained pre-driving voltage Vpre=15.5 V, the electron-emitting devices were pre-driven. At this time, the driving voltage waveform was a waveform shown in FIG. 11C, and V1=15.5 V, V12=15.0 V, T1=0.2 msec, T12=0.1 msec, the pulse interval T2=16.7 msec, and the pulse interval T22=0.05 msec were used.

During pre-driving, the current I1 at V1 and the current I12 at V12 were measured. While Epre=I1/(V1·dI1/dV1−2·I1) was calculated from the difference dI1 between I1 and I12, and the difference dV1 between V1 and V12, pre-driving was executed.

Pre-driving continued until the change rate of the value Epre reached about 9% for the device K, until the change rate of the value Epre reached about 7% for the device L, until the change rate of the value Epre reached about 5% for the device M, and until the change rate of the value Epre reached about 3% for the device N. No pre-driving was done for the device O.

The driving voltage V2 was set to 14.3 V, the anode, voltage was set to 1,000 V, and the devices were driven for a long time. Changes over time and variations in emission current during driving were the largest in the device O not pre-driven, and the second and third largest in the devices K and L. In the devices M and N, the emission current during driving hardly decreased and varied, and stable electron-emitting characteristics were attained.

A 14.3-V voltage pulses was applied to the devices M and N successively twice, and their field strength equivalent values were checked to find that the change rates of the field strength equivalent values were 2% or less. In particular, the device N exhibited a change rate lower than 1%.

As has been described above, the present invention can realize stable electron emission almost free from decrease and variations in emission current during normal driving.

The embodiment of the present invention has been described above. As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing an electron-emitting device which has at least two electrodes and emits electrons by applying a voltage between the two electrodes, comprising:

a voltage application step of applying a voltage V1 between the two electrodes, the voltage V1 being a voltage having a relationship with a maximum voltage value V2 applied to the electron-emitting device as a normal driving voltage after said voltage application step, so as to satisfy giving a current I flowing upon application of a voltage V when the voltage V falling within a voltage range causing electron emission upon application of the voltage between the two electrodes is applied between the two electrodes:

$$I=f(V) \quad (1)$$

and letting f'(V) be a differential coefficient of f(V) at the voltage V, a first condition:

$$f(V1)/\{V1\cdot f'(V1)-2f(V1)\}>f(V2)/\{V2\cdot f'(V2)-2f(V2)\} \quad (2)$$

wherein said voltage application step satisfies a second condition, upon completion of said voltage application step, wherein the second condition is defined by letting Xn-1 be a value of a right side of inequality (2) upon a first application of the pulse-like voltage V2 when the voltage V2 is applied as pulses successively twice between the two electrodes upon completion of said voltage application step, and Xn be a value of the right side of inequality (2) upon a second application of the pulse-like voltage V2, wherein Xn-1 and Xn satisfy:

$$(Xn\text{-}\mathbf{1}-Xn)/Xn\text{-}\mathbf{1}\leqq 0.02. \quad \text{(A)}$$

2. The method according to claim 1, wherein the second condition is that Xn-1 and Xn satisfy:

$$(Xn\text{-}\mathbf{1}-Xn)/Xn\text{-}\mathbf{1}\leqq 0.01. \quad \text{(B)}$$

3. The method according to claim 1, wherein application of the voltage V1 in said voltage application step is application of a pulse-like voltage.

4. The method according to claim 3, wherein said voltage application step comprises the step of applying the pulse-like voltage a plurality of number of times.

5. The method according to claim 1, wherein said voltage application step is performed while a value of a left side of the inequality (2) is monitored.

6. The method according to claim 1, wherein said voltage application step is performed in a high-vacuum atmosphere.

7. The method according to claim 1, wherein said voltage application step is performed in an atmosphere in which carbon and a carbon compound in the atmosphere have a partial pressure of not more than $1\times10^{-6}$ Pa.

8. The method according to claim 1, wherein the two electrodes have a gap between said two electrodes.

9. The method according to claim 8, wherein said voltage application step is performed in an atmosphere in which the gap between the two electrodes is not made narrow by deposition of a substance in the atmosphere or a substance originating from the substance in the atmosphere in said voltage application step.

10. The method according to claim 1, further comprising the step of forming the two electrodes having a gap between said two electrodes prior to said voltage application step.

11. The method according to claim 1, further comprising the step of forming the two electrodes having a gap between said two electrodes in which a deposit is deposited, prior to said voltage application step.

12. An electron-emitting device manufacturing apparatus used in the electron-emitting device manufacturing method defined claim 1, comprising:

a potential output portion for applying the voltage between the two electrodes.

13. A method of driving an electron-emitting device which has at least two electrodes and emits electrons by applying a voltage between the two electrodes, wherein the electron-emitting device undergoes the voltage application step of applying a voltage V1 between the two electrodes, the driving method comprises a driving process of driving the electron-emitting device using a maximum value of a normal driving voltage as V2, the voltage V1 is a voltage having a relationship with the voltage V2 so as to satisfy giving a current I flowing upon application of a voltage V when the voltage V falling within a voltage range causing electron emission upon application of the voltage between the two electrodes is applied between the two electrodes:

$$I=f(V) \quad (1)$$

and letting f'(V) be a differential coefficient of f(V) at the voltage V, a first condition:

$$f(\mathbf{V1})/\{\mathbf{V1}\cdot f'(\mathbf{V1})-2f(\mathbf{V1})\}>f(\mathbf{V2})/\{\mathbf{V2}\cdot f'(\mathbf{V2})-2f(\mathbf{V2})\} \quad (2)$$

the voltage application step satisfies a second condition, upon completion of the voltage application step, wherein the second condition is defined by letting Xn-1 be a value of a right side of inequality (2) upon a first application of the pulse-like voltage V2 when the voltage V2 is applied as pulses successively twice between the two electrodes upon completion of said voltage application step, and Xn be a value of the right side of inequality (2) upon a second application of the pulse-like voltage V2, wherein Xn-1 and Xn satisfy:

$$(Xn\text{-}\mathbf{1}-Xn)/Xn\text{-}\mathbf{1}\leqq 0.02. \quad \text{(A)}$$

14. A method of adjusting an electron-emitting device which has at least two electrodes and emits electrons by applying a voltage between the two electrodes, comprising:

a voltage application step of applying a voltage V1 between the two electrodes, the voltage V1 being a voltage having a relationship with a maximum voltage value V2 applied as a normal driving voltage after said voltage application step, so as to satisfy giving a current I flowing upon application of a voltage V when the voltage V falling within a voltage range causing electron emission upon application of the voltage between the two electrodes is applied between the two electrodes:

$$I=f(V) \quad (1)$$

and letting f'(V) be a differential coefficient of f(V) at the voltage V, a first condition:

$$f(\mathbf{V1})/\{\mathbf{V1}\cdot f'(\mathbf{V1})-2f(\mathbf{V1})\}>f(\mathbf{V2})/\{\mathbf{V2}\cdot f'(\mathbf{V2})-2f(\mathbf{V2})\} \quad (2)$$

wherein said voltage application step satisfies a second condition, upon completion of said voltage application step, wherein the second condition is defined by letting Xn-1 be a value of a right side of inequality (2) upon a first application of the pulse-like voltage V2 when the voltage V2 is applied as pulses successively twice between the two electrodes upon completion of said voltage application step, and Xn be a value of the right side of inequality (2) upon a second application of the pulse-like voltage V2, wherein Xn-1 and Xn satisfy:

$$(Xn\text{-}\mathbf{1}-Xn)/Xn\text{-}\mathbf{1}\leqq 0.02. \quad \text{(A)}$$

* * * * *

UNITED STATES PATENT AND TRADEMARK OFFICE

CERTIFICATE OF CORRECTION

PATENT NO. : 6,409,563 B1
DATED : June 25, 2002
INVENTOR(S) : Miki Tamura et al.

It is certified that error appears in the above-identified patent and that said Letters Patent is hereby corrected as shown below:

Title page,
Item [56], References Cited, OTHER PUBLICATIONS, in "H. Araki, … etc.", "Vacuum," should read -- Vacuum --.

Column 9,
Line 53, "basis" should read -- basic --.

Column 12,
Line 8, "below)" should read -- below). --.

Column 17,
Line 54, "ps" should be -- deleted --.

Signed and Sealed this

Eleventh Day of March, 2003

JAMES E. ROGAN
*Director of the United States Patent and Trademark Office*